US011492748B2

(12) United States Patent
Kasicky et al.

(10) Patent No.: US 11,492,748 B2
(45) Date of Patent: Nov. 8, 2022

(54) APPLIANCE LID THAT INCORPORATES INTERIOR STRUCTURAL FOAM REINFORCEMENT

(71) Applicant: WHIRLPOOL CORPORATION, Benton Harbor, MI (US)

(72) Inventors: Miroslav Kasicky, Poprad (SK); Juraj Nestorik, Kamienka (SK)

(73) Assignee: Whirlpool Corporation, Benton Harbor, MI (US)

( * ) Notice: Subject to any disclaimer, the term of this patent is extended or adjusted under 35 U.S.C. 154(b) by 193 days.

(21) Appl. No.: 16/587,708

(22) Filed: Sep. 30, 2019

(65) Prior Publication Data

US 2021/0095414 A1 Apr. 1, 2021

(51) Int. Cl.
*D06F 39/14* (2006.01)

(52) U.S. Cl.
CPC ..... *D06F 39/14* (2013.01)

(58) Field of Classification Search
CPC ..... D06F 39/14
USPC ..... 68/196
See application file for complete search history.

(56) References Cited

U.S. PATENT DOCUMENTS

| | | | | |
|---|---|---|---|---|
| 3,323,224 | A | 6/1967 | Lough et al. | |
| 5,496,104 | A | 3/1996 | Arnold et al. | |
| 8,015,848 | B2 | 9/2011 | Colon et al. | |
| 9,920,466 | B2 | 3/2018 | Brownlow | |
| 2005/0017605 | A1 | 1/2005 | Bauer | |
| 2009/0199601 | A1* | 8/2009 | Kim | D06F 39/083 68/208 |
| 2016/0245580 | A1* | 8/2016 | Brownlow | F25D 23/02 |
| 2018/0258577 | A1* | 9/2018 | Lee | D06F 37/04 |

FOREIGN PATENT DOCUMENTS

| | | | |
|---|---|---|---|
| EP | 1640494 | | 11/2008 |
| EP | 2554735 | | 2/2013 |
| EP | 3323927 | | 5/2018 |
| EP | 3450613 | | 3/2019 |
| JP | 2003265892 | | 9/2003 |
| JP | 2004188172 | | 7/2004 |
| JP | 2010166991 | A * | 8/2010 |
| KR | 20010001088 | | 1/2001 |
| KR | 20100065846 | | 6/2010 |

OTHER PUBLICATIONS

JP2010166991A—Machine translation (Year: 2010).*

* cited by examiner

*Primary Examiner* — Tinsae B Ayalew
(74) *Attorney, Agent, or Firm* — Price Heneveld LLP

(57) ABSTRACT

An operable panel for a laundry appliance includes a base member that includes a plurality of structural shear cavities that are separated by structural ribs. An upper member extends over the base member and the shear cavities. The upper member is configured to enclose at least a portion of the shear cavities. A plurality of foam members includes a central portion and opposing lateral portions. The plurality of foam members are positioned distal from a front portion and distal from a rear portion of the base member.

19 Claims, 6 Drawing Sheets

APPLIANCE LID THAT INCORPORATES INTERIOR STRUCTURAL FOAM REINFORCEMENT

FIELD OF THE DEVICE

The device is in the field of laundry appliances, and more specifically, an operable panel for a laundry appliance that incorporates an interior reinforcement utilizing a plurality of structural foam members.

SUMMARY OF THE DEVICE

According to one aspect of the present disclosure, a laundry appliance includes a drum that rotationally operates within a tub. A cabinet houses the tub and the drum and has an aperture for accessing the drum. An operable panel selectively covers the aperture and encloses the tub and the drum within the cabinet. The operable panel includes a base member that includes a plurality of structural ribs. An upper member extends over the base member and the structural ribs. The base member, the structural ribs and the upper member cooperate to form a plurality of structural shear cavities. A plurality of foam members are positioned within a portion of the shear cavities to increase rigidity of the operable panel.

According to another aspect of the present disclosure, an operable panel for a laundry appliance includes a base member that includes a plurality of structural shear cavities that are separated by structural ribs. An upper member extends over the base member and the shear cavities. The upper member is configured to enclose at least a portion of the shear cavities. A plurality of foam members includes a central portion and opposing lateral portions. The plurality of foam members are positioned distal from a front portion and distal from a rear portion of the base member.

According to yet another aspect of the present disclosure, a method for forming an operable panel for a laundry appliance includes forming a base member having a plurality of structural ribs. Foam members are disposed on the base member and between a portion of the structural ribs. An upper member is formed. The upper member is disposed onto the base member and the foam members to form a plurality of shear cavities.

These and other features, advantages, and objects of the present disclosure will be further understood and appreciated by those skilled in the art by reference to the following specification, claims, and appended drawings.

Figure 1:
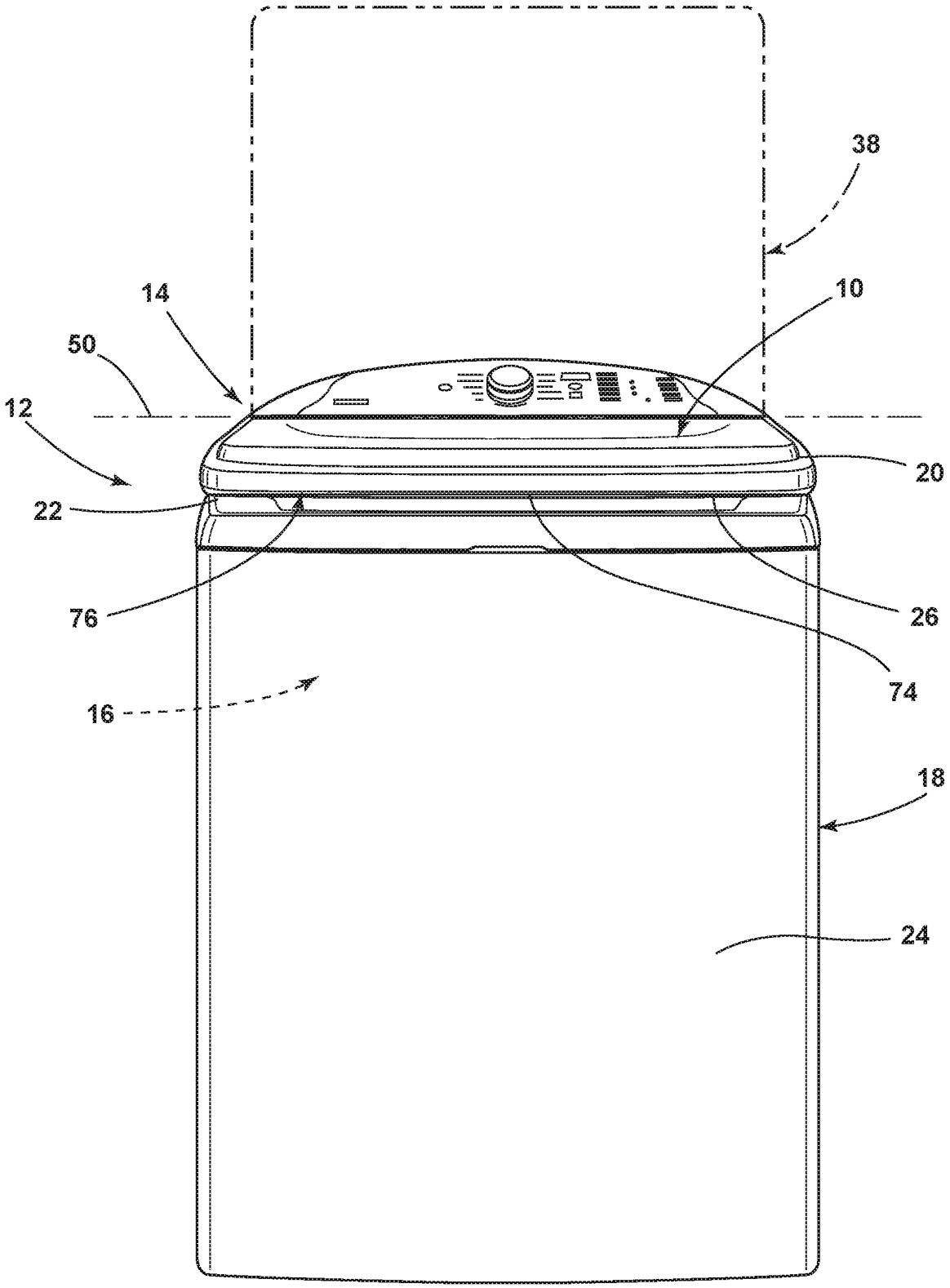
FIG. 1 is a front perspective view of a laundry appliance having a lid that incorporates an aspect of the structural foam reinforcement.
Figure 2:
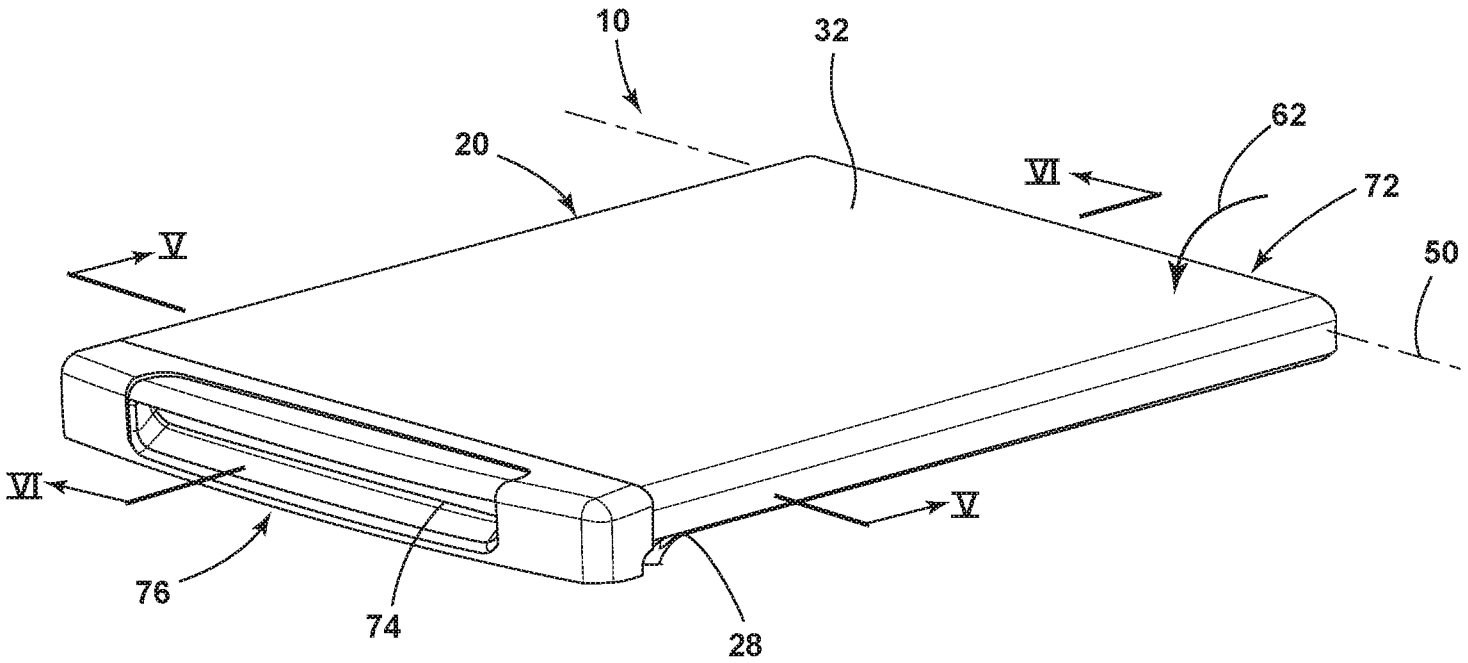
FIG. 2 is a top perspective view of a lid for a laundry appliance that incorporates an aspect of the structural foam reinforcement.
Figure 3:
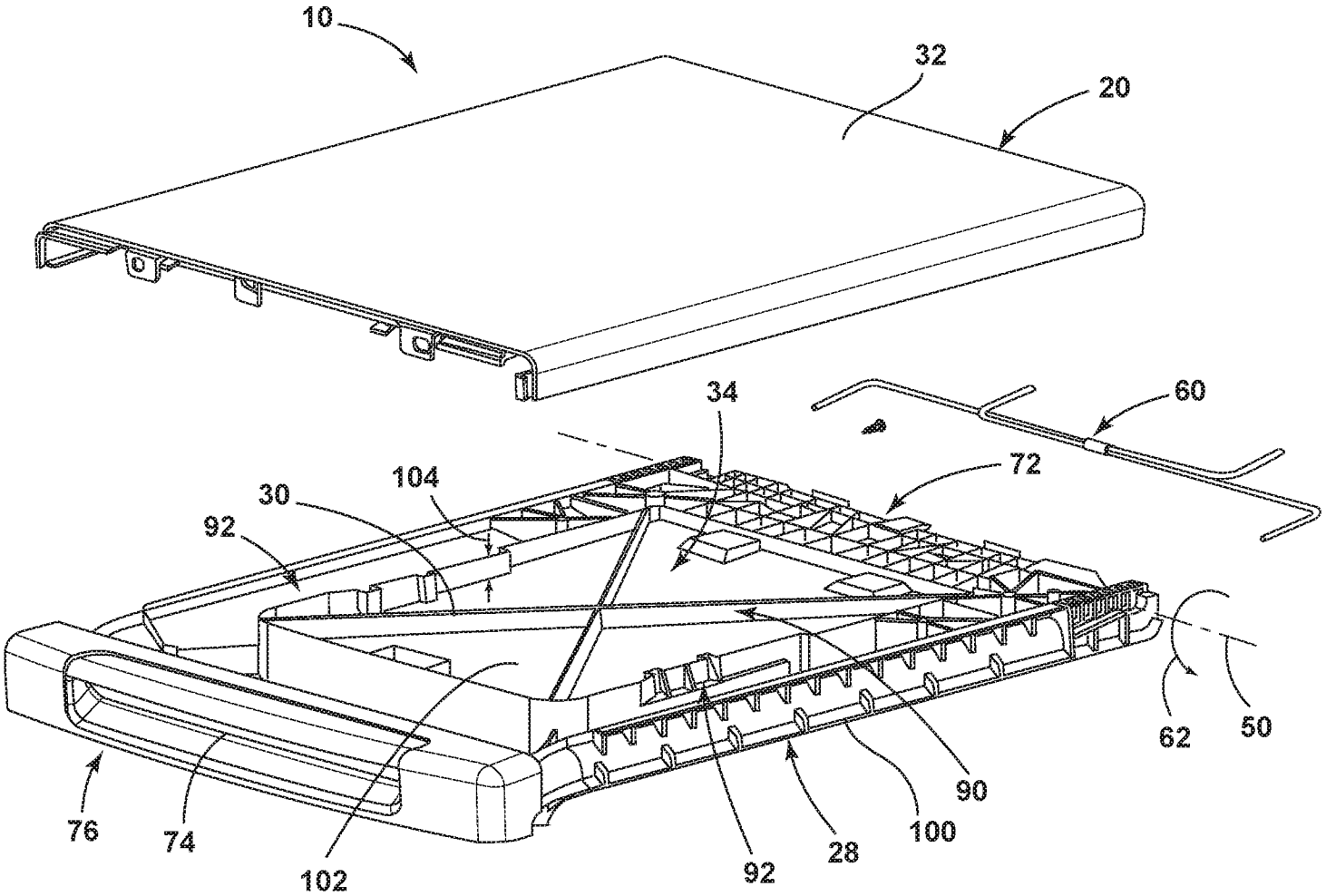
FIG. 3 is an exploded perspective view of the appliance lid of FIG. 2 and shown before installation of the structural foam reinforcements.

The components in the figures are not necessarily to scale, emphasis instead being placed upon illustrating the principles described herein.

DETAILED DESCRIPTION

The present illustrated embodiments reside primarily in combinations of method steps and apparatus components related to an appliance lid having a plurality of structural foam inserts. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With respect to FIGS. 1-6, reference numeral 10 generally refers to an operable panel that is included within an appliance 12, typically a laundry appliance. The operable panel 10 can be selectively operated between an open position 38 and a closed position 14 to allow access within an interior compartment 16 of the cabinet 18 for the appliance 12. As exemplified in FIG. 1, the operable panel 10 can be in the form of a lid 20 that is positioned on a top panel 22 of the cabinet 18, such as in the form of a top-load laundry appliance. The operable panel 10 can also be disposed on a front panel 24 of a structural cabinet 18 for a front-load laundry appliance (not shown). In such a condition, the operable panel 10 can be in the form of an operable door that rotationally operates with respect to the structural cabinet 18 and the interior portions thereof. According to various aspects of the device, the laundry appliance 12 includes a drum that rotationally operates within a tub. A cabinet 18 houses the tub and the drum and includes an aperture 26 for accessing the rotationally operable drum. The operable panel 10 is positioned to selectively cover the aperture 26 and enclose the tub and the drum within the cabinet 18. The operable panel 10, typically in the form of the lid 20, includes a base member 28 that includes a plurality of structural ribs 30. An upper member 32 extends over the base member 28 and the structural ribs 30. The base member 28, the structural ribs 30 and the upper member 32 cooperate to form a plurality of structural shear cavities 34 within the lid 20. A plurality of foam members 36 are positioned within a portion of the shear cavities 34 to increase the rigidity of the lid 20 as it operates between open and closed positions 38, 14.

Figure 4:
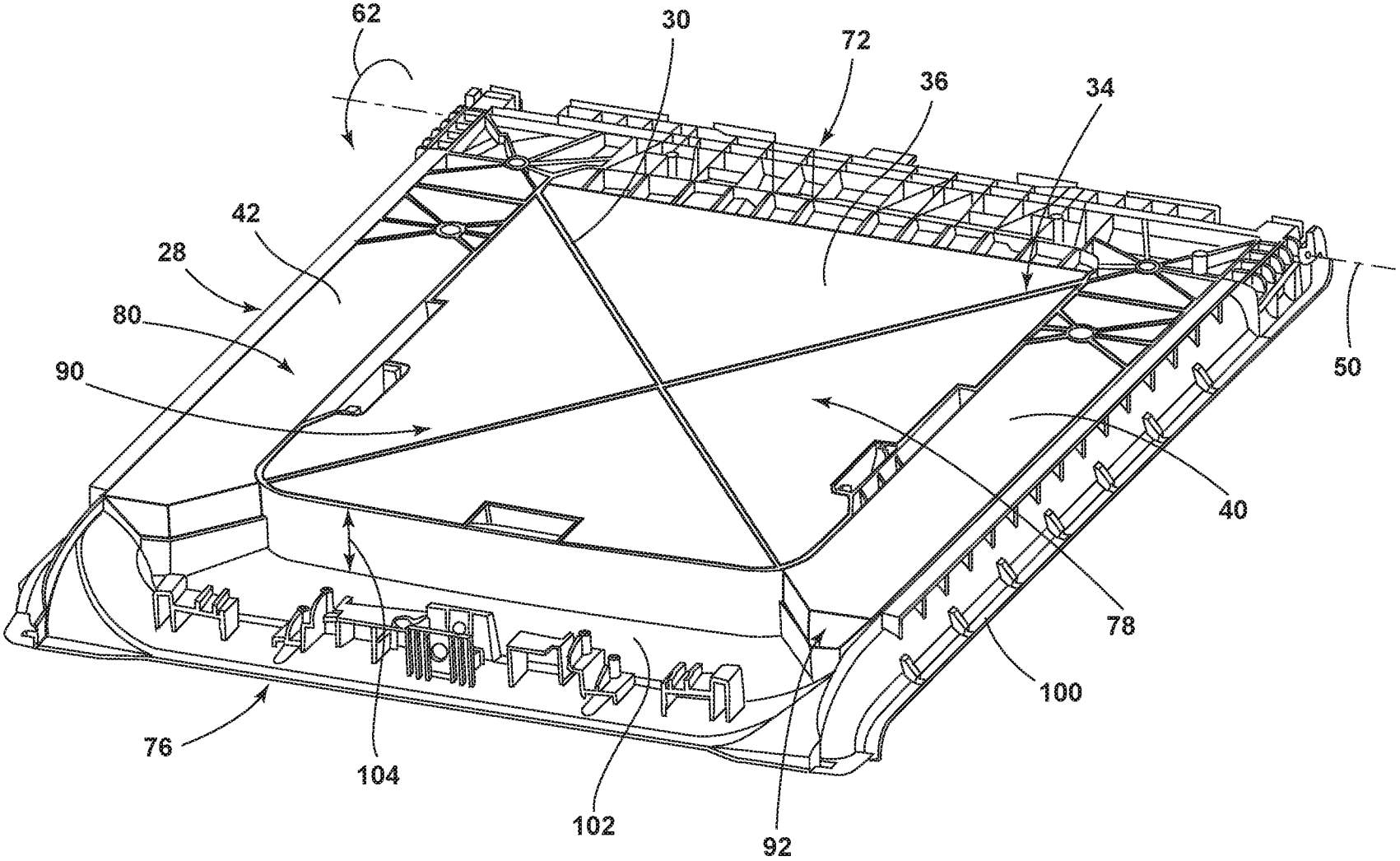
FIG. 4 is a top perspective view of a base member for the operable panel of FIG. 2 and showing the installation of the structural foam reinforcements.
Figure 5:
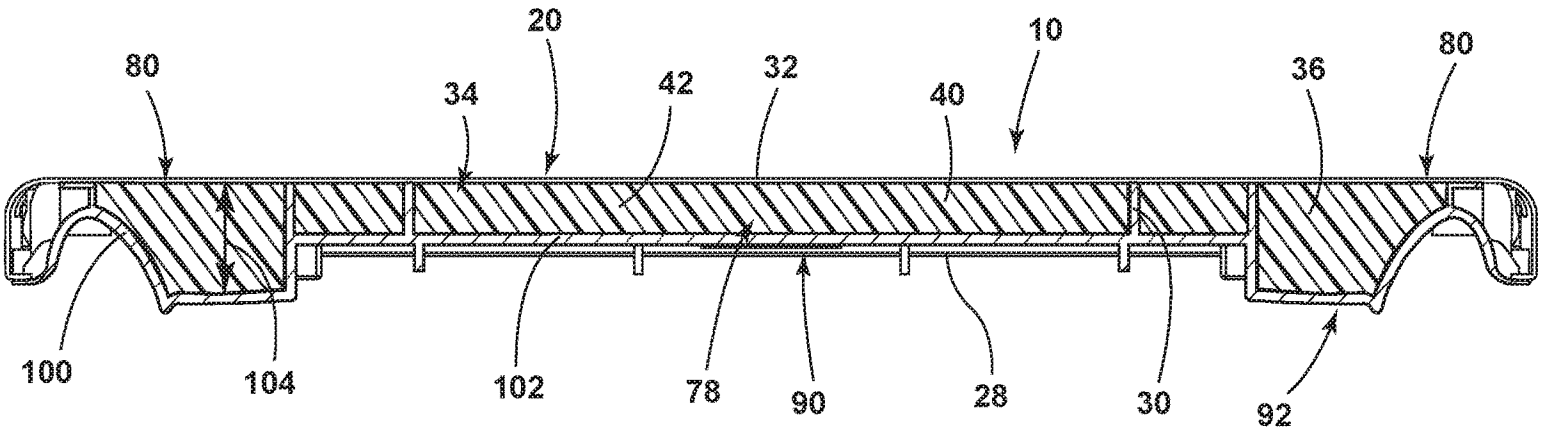
FIG. 5 is a cross-sectional view of the appliance lid of FIG. 2 taken along line V-V.
Figure 6:
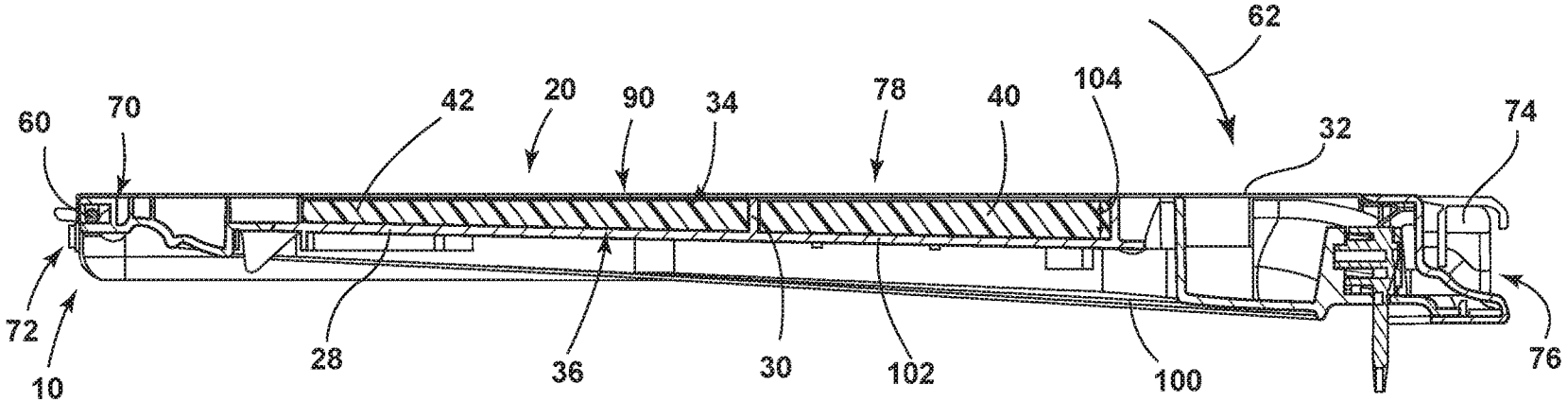
FIG. 6 is a cross-sectional view of the operable panel of FIG. 2 taken along line VI-VI.
Figure 7:
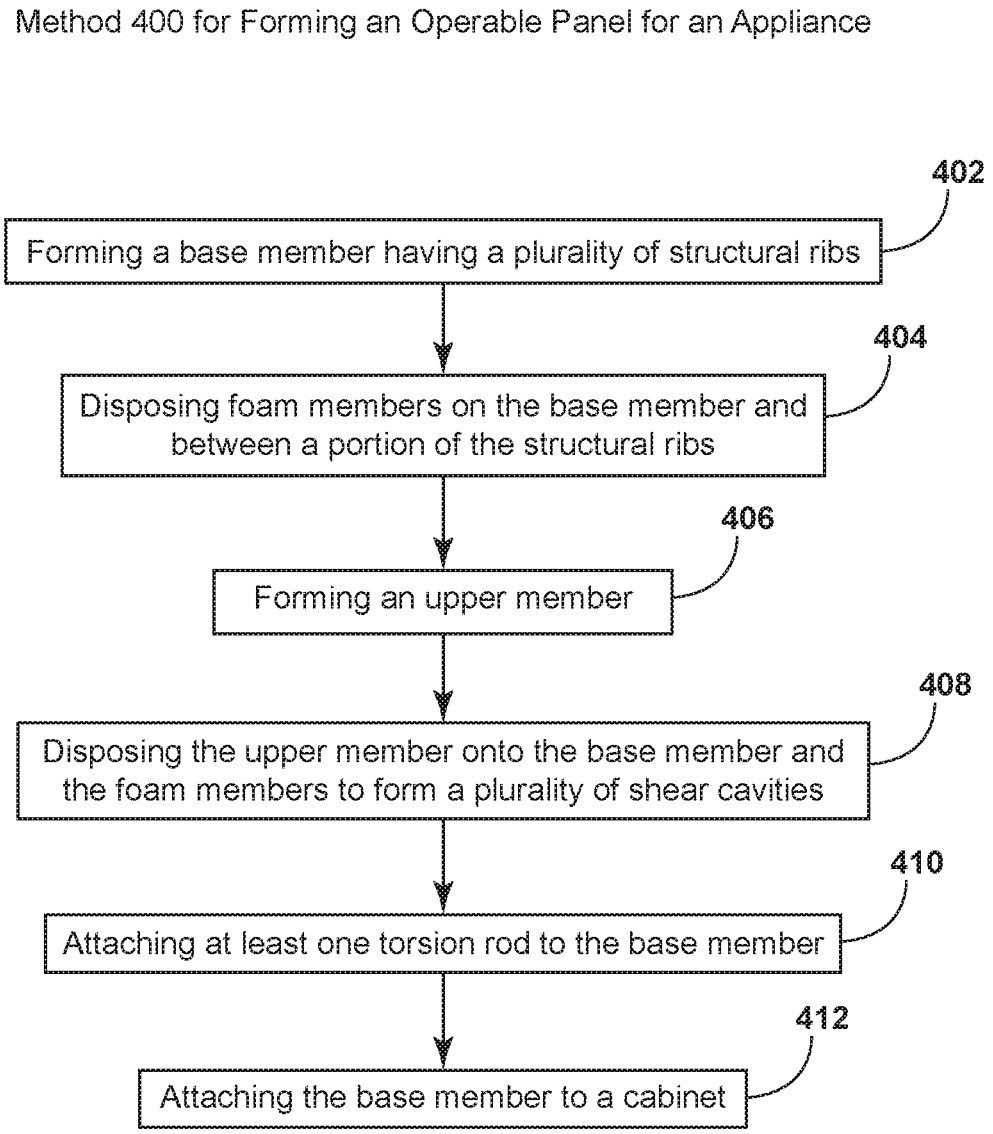
FIG. 7 is a schematic flow diagram illustrating a method for assembling an operable panel fora laundry appliance.

As exemplified in FIGS. 4-6, the plurality of foam members 36 are typically in the form of individual portions of a foam material 40 that are disposed within a portion of the structural shear cavities 34 of the lid 20 for the laundry appliance 12. The foam members 36 can be in the form of an expandable spray foam that is sprayed within the area bound by the structural ribs 30 of the base member 28. The expandable foam 42 occupies the entire space of the corresponding shear cavity 34 that is defined within the structural ribs 30. Accordingly, when the upper member 32 is placed on the base member 28, the expandable foam 42 that forms the plurality of foam members 36 is enclosed within the structural shear cavities 34 and the expandable foam 42 substantially occupies the entire space of the structural shear cavities 34.

The use of the plurality of foam members 36 provides a rigidity to the lid 20 as the lid 20 operates about a rotational axis 50 between the open and closed positions 38, 14. This rigidity is useful during operation of the appliance 12 where certain rattling, vibration, and other motion of the laundry appliance 12 can result in undesirable noise and vibration within the lid 20.

According to various aspects of the device, as exemplified in FIGS. 3-6, the lid 20 can include at least one torsion rod 60 that extends between the base member 28 of the lid 20 and the cabinet 18. The at least one torsion rod 60 operates to exert a biasing force 62 on the lid 20 towards one of the open positions 38 and the closed position 14 and against the cabinet 18. The structural reinforcing properties of the plurality of foam members 36 cooperates with the torsion rods 60 to prevent deflection of the lid 20 as the torsion rods 60 bias the lid 20 in a predetermined direction. Additionally, the torsion rods 60 and the plurality of foam members 36 cooperate to minimize vibration, rattling, and other noise that may emanate from the lid 20 during operation of the laundry appliance 12.

Typically, the base member 28 of the lid 20 is a plastic member that is able to receive the plurality of foam members 36. The base member 28 can be an injection molded piece that includes the structural ribs 30 that are integrally formed therein. Accordingly, after the expandable foam 42 is disposed between the structural ribs 30, the base member 28 and the plurality of foam members 36 substantially form an integral and unitary piece as a result of adhesion between the expandable foam 42 and the plastic material of the base member 28. The upper member 32 is typically a metallic member that can be fastened, latched, or otherwise secured to the base member 28 for enclosing the structural shear cavities 34 that contain the expandable foam 42 in the form of the foam members 36 within the shear cavities 34.

As exemplified in FIGS. 1-6, the aperture 26 of the cabinet 18 can be disposed within a top panel 22 of the cabinet 18 such that the operable panel 10 defines a lid 20 of the cabinet 18. In such an embodiment, the lid 20 is attached to the cabinet 18 via a hinge member 70 that is positioned at a rear portion 72 of the lid 20. The lid 20 can also include a handle 74 that is positioned at a front portion 76 of the lid 20. Typically, the handle 74 is attached to the base member 28 and can help to secure the upper members 32 to the base member 28. The plurality of foam members 36 that provide the structural reinforcement of the structural shear cavities 34 are positioned distal from the handle 74 and the hinge member 70 and torsion rods 60. Accordingly, the plurality of foam members 36 include a central portion 78 and opposing lateral portions 80.

According to various aspects of the device, the central portion 78 of the foam members 36 can be divided into a plurality of individual sections that are separated by formations of structural ribs 30 that extend through the medial region 90 of the base member 28 for the lid 20. Similarly, the opposing lateral portions 80 of the foam members 36 can also be separated by various structural ribs 30 that extend through the lateral regions 92 of the base member 28 for the lid 20. In this manner, the plurality of foam members 36 that are formed through expandable foam 42, in combination with the structural ribs 30, serve to reinforce the lid 20 and diminish the amount of vibration, rattling, and other noise that may occur during operation of the appliance 12 and during movement of the lid 20 between the open and closed positions 38, 14. This combination of components also serves to limit the amount of deformation, bending, and other internal stresses that may be experienced by the lid 20 during operation of the appliance 12 and movement of the lid 20 between the open and closed positions 38, 14 and in opposition to the biasing force 62 exerted by the torsion rods 60.

The opposing lateral portions 80 of the plurality of foam members 36 can be positioned proximate the shoulder 100 of the lid 20 that is configured to engage a portion of the top panel 22 of the cabinet 18. These shoulder portions of the base member 28 can be a source of undesirable noise during operation of the appliance 12. Accordingly, the opposing lateral portions 80 of the plurality of foam members 36 may include a thicker section of the expandable foam 42 to provide increased reinforcement to diminish the amount of undesirable noise that may emanate from the lid 20 during operation of the appliance 12 and operation of the door between the open and closed positions 38, 14.

Additionally, the base member 28 can include a base platform 102 that is sloped in a generally downward direction from the rear portion 72 toward the front portion 76 of the base member 28. Accordingly, the depth 104 of the structural shear cavities 34 tends to increase toward the handle 74 of the lid 20. Through this configuration, the depth 104 of the structural shear cavities 34 increases and the amount of the expandable foam 42 also increases in the areas nearer the handle 74 of the lid 20. Through this configuration, operation of the lid 20 between the open and closed positions 38, 14 may result in increased moment or torque-type forces being exerted within areas nearer the handle 74 of the lid 20. This is primarily because of the distance and longer moment arm between the handle 74 and the torsion rods 60, the source of the biasing force 62. The thickened portions of the expandable foam 42 that are present within a central portion 78 and the opposing lateral portions 80 of the foam members 36 serves to increase the structural reinforcement of the lid 20 within these areas to counteract the moment and torque-type forces that may be experienced within the lid 20, as a result of the biasing force 62. Accordingly, each of the foam members 36 tends to have a thinner cross-sectional depth 104 in areas nearer the torsion rods 60 and a thicker cross-sectional depth 104 within areas near the handle 74 of the lid 20. These differences in thickness provide a balance between the overall weight of the lid 20 and the amount of structural reinforcement provided to the lid 20 through the use of the expandable foam 42 that forms the foam members 36 that are disposed within the structural shear cavities 34.

Referring again to FIGS. 1-6, the operable panel 10 for the laundry appliance 12 includes the base member 28 that includes the plurality of structural shear cavities 34 that are separated by structural ribs 30. The upper member 32 extends over the base member 28 and the shear cavities 34. In this manner, the upper member 32 is configured to enclose at least a portion of the shear cavities 34 defined within the base member 28. The plurality of foam members 36 includes the central portion 78 and opposing lateral portions 80. The plurality of foam members 36 are positioned distal from a front portion 76 and distal from a rear portion 72 of the base member 28.

In various aspects of the device, the aperture 26 that is defined within the cabinet 18 can be positioned within a front portion 76 of the cabinet 18. In such an embodiment, the operable panel 10 can be in the form of a rotationally operable door panel that rotates about a vertically-oriented rotational axis 50 between the open and closed positions 38, 14. Typically, the operable panel 10 will be in the form of a lid 20 that is engaged with a top panel 22 of the structural cabinet 18. In such an embodiment, the lid 20 rotates about a horizontally-oriented rotational axis 50 to define the open and closed positions 38, 14.

Referring now to FIGS. 1-7, having described various aspects of the operable panel 10 for the structural cabinet 18, a method 400 is disclosed for forming the operable panel 10 for a laundry appliance 12. According to the method 400, a base member 28 is formed that includes the plurality of structural ribs 30 (step 402). After formation of the base member 28, an expandable foam 42 is disposed on the base members 28 and between portions of the structural ribs 30 (step 404). The expandable foam 42 forms the plurality of foam members 36 that are contained within the structural shear cavities 34 that are defined between the structural ribs 30 of the base member 28. According to the method 400, the upper member 32 is formed (step 406) and the upper member 32 is disposed onto the base member 28 and the expandable foam 42 to form a plurality of shear cavities 34 (step 408). According to the method 400, at least one torsion rod 60 can be attached to the base member 28 (step 410). As discussed previously, the at least one torsion rod 60, typically two torsion rods 60, are configured to exert the biasing force 62 to bias the base member 28 toward the closed position 14 and against the structural cabinet 18. According to the method 400, the base member 28 is attached to the cabinet 18 (step 412). The operable panel 10 is selectively operable relative to the cabinet 18 between the open and closed positions 38, 14.

In certain aspects of the device, the torsion rods 60 can also exert the biasing force 62 in an upward direction and toward the open position 38. This upward biasing force 62 can be used to assist the user in lifting the lid 20 to the open position 38. In this configuration, the torsion rods 60 are used as a power assist mechanism to help the user lift the lid 20 to the open position 38 and also prevent the lid 20 from impacting the top panel 22 at a force of gravity or greater when moved toward the closed position 14.

According to various aspects of the device, the use of the expandable foam 42 that is disposed within the structural shear cavities 34 is intended to increase the rigidity and overall structural integrity of the operable panel 10. The increased rigidity of the lid 20 serves to limit the amount of vibration, rattling, and other undesirable noise during operation of the appliance 12. Additionally, the use of the expandable foam 42 contained within the structural shear cavities 34 limits the amount of deflection that is experienced by the lid 20. This is particularly true as the torsion members bias the lid 20 toward the closed position 14, or the open position 38, and during operation of the lid 20 to the open position 38. Necessarily, movement of the lid 20 in a certain direction counteracts a biasing force 62 exerted by the torsion rods 60 that biases the lid 20 toward one of the open position 38 and the closed position 14. These moment and torque-type forces are structurally accounted for through the incorporation of the structural shear cavities 34 having the expandable foam 42 incorporated therein.

It should be understood that the use of the expandable foam 42 within the structural shear cavities 34 of the operable panel 10 can be incorporated within a variety of operable panels 10 for a range of appliances 12. Such appliances 12 can include, but are not limited to, dishwashers, ovens, refrigerating appliances, countertop appliances, small appliances, and other similar household and commercial appliances and fixtures.

According to another aspect of the present disclosure, a laundry appliance includes a drum that rotationally operates within a tub. A cabinet houses the tub and the drum and has an aperture for accessing the drum. An operable panel selectively covers the aperture and encloses the tub and the drum within the cabinet. The operable panel includes a base member that includes a plurality of structural ribs. An upper member extends over the base member and the structural ribs. The base member, the structural ribs and the upper member cooperate to form a plurality of structural shear cavities. A plurality of foam members are positioned within a portion of the shear cavities to increase rigidity of the operable panel.

According to another aspect, at least one torsion rod extends from the base member to the cabinet, wherein the torsion rod biases the operable panel toward a closed position.

According to yet another aspect, the operable panel is attached to the cabinet via a hinge member.

According to another aspect of the present disclosure, the base member is plastic.

According to another aspect, the upper member is metallic.

According to yet another aspect, the aperture is on a top panel of the cabinet and the operable panel defines a lid of the cabinet.

According to another aspect of the present disclosure, the plurality of foam members are positioned distal from a handle and distal from the at least one torsion rod.

According to another aspect, the plurality of foam members includes a central portion and opposing lateral portions.

According to yet another aspect, the aperture is positioned within a front portion of the cabinet and the operable panel is a rotationally operable door panel.

According to another aspect of the present disclosure, an operable panel for a laundry appliance includes a base member that includes a plurality of structural shear cavities that are separated by structural ribs. An upper member extends over the base member and the shear cavities. The upper member is configured to enclose at least a portion of the shear cavities. A plurality of foam members includes a central portion and opposing lateral portions. The plurality of foam members are positioned distal from a front portion and distal from a rear portion of the base member.

According to another aspect, at least one torsion rod is positioned within the rear portion of the base member.

According to yet another aspect, the operable panel is a lid for a top-load laundry appliance.

According to another aspect of the present disclosure, the upper member is metallic.

According to another aspect, the base member is plastic.

According to yet another aspect, the operable panel is an operable door for a front-load laundry appliance.

According to another aspect of the present disclosure, the base member includes a base platform that tapers away from the upper member in a direction toward the front portion.

According to another aspect, the foam members include an expandable foam material.

According to yet another aspect, a method for forming an operable panel for a laundry appliance includes forming a base member having a plurality of structural ribs. Foam members are disposed on the base member and between a portion of the structural ribs. An upper member is formed. The upper member is disposed onto the base member and the foam members to form a plurality of shear cavities.

According to another aspect of the present disclosure, at least one torsion rod is attached to the base member, wherein the torsion rod is configured to bias the base member toward a closed position.

According to another aspect, the base member is attached to a cabinet, wherein the operable panel is selectively operable relative to the cabinet between open and closed positions.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance comprising:

a drum that rotationally operates within a tub;

a cabinet that houses the tub and the drum and having an aperture for accessing the drum;

an operable panel that selectively covers the aperture and encloses the tub and the drum within the cabinet, the operable panel comprising:

a base member that includes a plurality of structural ribs and a base platform that is disposed within a medial region of the base member, wherein lateral regions of the base member are positioned outside of the base platform and the medial region, and wherein the plurality of structural ribs includes a pair of intersecting walls that are disposed on the base platform and that continuously and linearly extend a full width of the medial region, the pair of intersecting walls defining enlarged triangular cavities that occupy the medial region, wherein the pair of intersecting walls are configured to provide a relatively lower level of rigidity compared to the plurality of structural ribs located in the lateral regions;

an upper member that extends over the base member and the plurality of structural ribs, wherein the base member, the plurality of structural ribs and the upper member cooperate to form a plurality of enclosed structural shear cavities; and a plurality of foam members that are positioned within a portion of the plurality of enclosed structural shear cavities to increase rigidity of the operable panel, wherein the medial region above the base platform includes a central portion of the plurality of foam members having a thickness that is less than a thickness of lateral portions of the plurality of foam members that are positioned within the lateral regions of the base member, and wherein the plurality of foam members includes enlarged triangular foam members that rest upon the base platform and occupy the enlarged triangular cavities, respectively.

2. The laundry appliance of claim 1, further comprising at least one torsion rod that extends from the base member to the cabinet, wherein the torsion rod biases the operable panel toward a closed position.

3. The laundry appliance of claim 1, wherein the operable panel is attached to the cabinet via a hinge member.

4. The laundry appliance of claim 1, wherein the base member is plastic.

5. The laundry appliance of claim 4, wherein the upper member is metallic.

6. The laundry appliance of claim 1, wherein the aperture is on a top panel of the cabinet and the operable panel defines a lid of the cabinet.

7. The laundry appliance of claim 2, wherein the plurality of foam members are positioned distal from a handle and distal from the at least one torsion rod.

8. The laundry appliance of claim 1, wherein the plurality of foam members within the central portion include four of the enlarged triangular foam members that fully occupy the enlarged triangular cavities, respectively.

9. The laundry appliance of claim 1, wherein the aperture is positioned within a front portion of the cabinet and the operable panel is a rotationally operable door panel.

10. The laundry appliance of claim 1, further comprising a handle that is attached to the base member and is configured to secure the upper member to the base member.

11. An operable panel for a laundry appliance, the operable panel comprising:

a base member that includes a plurality of structural shear cavities that are separated by structural ribs, the base member having a base platform that defines a medial region that is positioned between opposing lateral regions of the base member, wherein the structural ribs include a pair of intersecting walls that extend continuously and linearly across the base platform and the medial region of the base member and define enlarged triangular shear cavities of the plurality of structural shear cavities, wherein the pair of intersecting walls are configured to provide a relatively lower level of rigidity compared to the structural ribs located within the opposing lateral regions;

an upper member that extends over the base member and the plurality of structural shear cavities, the upper member configured to enclose at least a portion of the plurality of structural shear cavities; and a plurality of foam members that includes a thinner central portion positioned within the medial region of the base member and that is disposed on the base platform of the base member, the plurality of foam members also including opposing thicker lateral portions that are positioned outside of the base platform and extend below the base platform, wherein the plurality of foam members are positioned distal from a front portion and distal from a rear portion of the base member, and wherein the thinner central portion includes a plurality of triangular foam members that fully occupy the enlarged triangular shear cavities defined above the base platform.

12. The operable panel of claim 11, further comprising at least one torsion rod that is positioned within the rear portion of the base member.

13. The operable panel of claim 11, wherein the operable panel is a lid for a top-load laundry appliance.

14. The operable panel of claim 11, wherein the upper member is metallic.

15. The operable panel of claim 14, wherein the base member is plastic.

16. The operable panel of claim 11, wherein the operable panel is an operable door for a front-load laundry appliance.

17. The operable panel of claim 11, wherein the base platform tapers away from the upper member in a direction toward the front portion.

18. The operable panel of claim 11, wherein the plurality of foam members include an expandable foam material.

19. The operable panel of claim 11, further comprising a handle that is attached to the base member and is configured to secure the upper member to the base member.

* * * * *